United States Patent [19]

Davies et al.

[11] Patent Number: 4,832,705

[45] Date of Patent: May 23, 1989

[54] METHOD OF PRODUCING ABRASIVE PARTICLE-CONTAINING BODIES

[76] Inventors: Idwal Davies, 12A Ffordd Argoed, Mold, Clwyd; John Bellis, 10 Larchwood Road, Borras Park, Wrexham, both of Wales

[21] Appl. No.: 202,806

[22] Filed: Jun. 3, 1988

[30] Foreign Application Priority Data

Jun. 5, 1987 [GB] United Kingdom ..... 8713177

[51] Int. Cl.[4] ..... B24D 3/00

[52] U.S. Cl. ..... 51/293; 51/295; 51/309

[58] Field of Search ..... 51/293, 295, 309

[56] References Cited

U.S. PATENT DOCUMENTS

| | | | |
|---|---|---|---|
| 3,960,518 | 6/1976 | Hall | 51/293 |
| 4,038,046 | 7/1977 | Supkis | 51/295 |
| 4,063,909 | 12/1977 | Mitchell | 51/295 |
| 4,187,082 | 2/1980 | Guerra | 51/295 |
| 4,255,164 | 3/1981 | Butzke et al. | 51/295 |
| 4,263,755 | 4/1981 | Globus | 51/295 |
| 4,457,765 | 7/1984 | Wilson | 51/293 |
| 4,690,691 | 9/1987 | Komanduri | 51/293 |

*Primary Examiner*—Paul Lieberman
*Assistant Examiner*—Willie Thompson
*Attorney, Agent, or Firm*—Scully, Scott, Murphy & Presser

[57] ABSTRACT

The invention provides a method of producing an abrasive particle, particularly diamond, containing strip. The strip will contain 50 percent or less by volume of the diamond particles and a supporting matrix which will generally be metal. The method involves making a mixture of the abrasive particles and the supporting matrix in particulate form, causing a thin layer of the mixture to be deposited on to a support surface, compacting the layer and heat treating the compacted layer under conditions which will not lead to degradation of the abrasive particles to produce the strip.

17 Claims, No Drawings

METHOD OF PRODUCING ABRASIVE PARTICLE-CONTAINING BODIES

BACKGROUND OF THE INVENTION

This invention relates to a method of producing abrasive particle-containing bodies.

Abrasive particle-containing products are widely used in industry and come in a variety of forms and shapes. Examples of such abrasive products are grinding wheels which have a hub carrying a working portion which consists of a plurality of discrete abrasive particles held in a suitable bonding or support matrix. The bonding or support matrix may be ceramic, metal or resinous in nature. Another example of an abrasive product is an abrasive compact which consists of a polycrystalline mass of abrasive particles bonded into a hard conglomerate and made under elevated temperature conditions similar to those used for producing diamond or cubic boron nitride synthetically.

British patent specification No. 1,212,681 describes a method of making a metallic strip by depositing on to a support surface a coating comprising a suspension of powdered metal in a solution or dispersion of a film-forming binder material in water, drying the resulting coating on the support surface, rolling the coating to effect compaction and heat treating the compacted coating at a temperature below the melting point of the metal. The specification states that carbon fibres or metal fibres may be incorporated into the powdered metal to modify the properties of the final strip. There is no disclosure or suggestion in the specification that the method may be used for producing abrasive particle-containing bodies.

SUMMARY OF THE INVENTION

According to the present invention, there is provided a method of producing an elongate, thin, coherent and self-supporting body comprising a mass of discrete abrasive particles uniformly dispersed and held in a support matrix, the abrasive particles being present in an amount not exceeding 50% by volume of the body, including the steps of providing a mixture of the abrasive particles and the support matrix in particulate form, causing a thin layer of this mixture to be deposited onto a support surface, compacting the layer and heat treating the compacted layer under conditions which will not lead to degradation of the abrasive particles to produce the body.

DETAILED DESCRIPTION OF THE INVENTION

The method thus uses broadly the techniques and methods described in British Pat. No. 1,212,681 to produce abrasive particle-containing bodies. The bodies will be elongate, thin, coherent and self-supporting and will typically take the form of a strip, sheet or the like. Such bodies have a variety of applications. For example, they may be used as wear and abrasion resistant surfaces. The strips may be produced with a certain degree of flexibility or ductility and so may be glued or brazed to a substrate to provide that substrate with a highly wear and abrasion resistant surface. Such wear-resistant surfaces have particular application in the mineral processing and textile processing industries. Further, the bodies may be bonded to suitable support substrates and used in machining and lapping operations. The bodies may also be used as saw segments.

The body will be thin and will generally have a thickness which does not exceed 1 mm. Typically, the thickness of the body will be in the range 0.2 to 0.7 mm, preferably in the range 0.2 to 0.5 mm.

The bodies produced by the method of the invention will contain 50% or less by volume of a mass of discrete abrasive particles. Generally, the abrasive particle content will be in the range of 20 to 40% by volume of the body. Examples of suitable abrasive particles are diamond, cubic boron nitride, silicon carbide, tungsten carbide and chromium boride. The particles will generally have an average size of less than 500 microns, preferably less than 100 microns.

The support matrix may be metallic or resinous in nature, but is preferably metallic in nature. When the matrix is metallic, it is preferably an iron-containing alloy such as a stainless steel. Examples of other suitable metallic support matrices are nickel and cobalt based alloys. The alloys may be treated by nitriding or ion implantation to improve their abrasion resistance.

The compaction of the thin layer which is deposited on the support surface may be achieved by passing that layer through rollers. The pressure applied to achieve compaction will vary according to the nature of the support matrix, but will typically not exceed 60 tons. Standard and well known lubricants may be used to ensure that the layer passes through the rollers smoothly.

The heat treatment conditions will vary according to the nature of the support matrix and the abrasive used. When the support matrix is metallic, the heat treatment is preferably carried out at a temperature below the melting point of the metal. Typically the metal will have a melting point about 1500° C. and heat treatment will be carried out at a temperature in the range 600° to 1000° C. for a period of 1 to 20 minutes.

The heat treatment must take place under conditions which will not lead to degradation of the abrasive particle. For diamond particles the conditions must be such as not to lead to any substantial formation of graphite. For cubic boron nitride particles, the conditions must be such as not to lead to any substantial formation of hexagonal boron nitride. For these two abrasive particles it is thus preferably for the heat treatment to take place in a non-oxidising, reducing or inert atmosphere. Examples of such atmospheres are hydrogen, hydrogen/nitrogen and hydrogen/argon.

The particulate mixture will generally have a suitable binder added to it prior to passing it to the compaction step. In this regard, the particulate mixture may, for example, by slurried with a film-forming binder material in water, the slurry deposited on the support surface and a major part of the water removed, e.g. by heating from the slurry prior to the compaction step. The binder material may be dissolved or dispersed in the water. The binder is preferably one which decomposes or volatilises at a temperature of 300° C. or higher which enables it to be removed from the particulate mixture during the heat treatment step. The binder is typically a cellulose binder such as methyl cellulose.

The body which is produced after the heat treatment step is coherent and self-supporting. When the body has a metal matrix, it may thereafter be subjected to further compaction and heat treatment steps or a combination of these steps to modify the properties of the body. The compaction step or steps will be as described above.

Similarly the subsequent heat treatment or treatments, which have the effect of annealing the metal matrix, will be as described above.

An example of the invention will now be described. Several diamond-containing metallic strips were produced by the method of the invention. In all cases, the thickness of the strips was less than 1 mm and the strips were coherent and self-supporting. The diamonds had an average particle size in the range 63 to 88 microns and were present in an amount of 37.5% by volume of the strip. The nature of the metallic support matrix was varied as was the post-heat treatments. All the strips were produced by making a slurry of the diamond particles and the particular metal matrix in particulate form in a water dispersion of a cellulose binder, depositing the slurry in the form of a thin layer on a support surface, drying the resulting layer by heating, compacting the by passing the layer through rollers and heat treating the compacted layer at about 960° C. for two minutes in a hydrogen atmosphere to produce the strip. The various matrices and post-heat treatments used and the hardnesses obtained for the strips are set out in the table below:

TABLE

| Sample | Matrix | Post-Heat Treatment | Hardness |
|---|---|---|---|
| 1 | Nickel | A | 134 |
| 2 | Nickel | B | 262 |
| 3 | Nickel | C | 130 |
| 4 | Ni/Cr (80/20) | B | 363 |
| 5 | Co/Fe/Ni(91.5/6/2.5) + 10% WC | D | 300 |
| 6 | Ferritic Stainless Steel | C | 325 |
| 7 | Martensitic Stainless Steel (+0,1% graphite) | C | 325 |
| 8 | Austenitic Stainless Steel | C | 550 |
| 9 | Nickel, hard-facing braze alloy | C | — |

Notes on the Table:

1. A means the strip was given no post-heat treatment
2. B means that the strip, after heat-treatment, was compacted (i.e. cold rolled) only.
3. C means the strip, after heat-treatment, was compacted (i.e. cold rolled) and thereafter annealed at a temperature of about 960° C. for two minutes in an atmosphere of hydrogen.
4. The nickel hard facing braze alloy had the following composition:

| Metal | Percent by Weight |
|---|---|
| Nickel | 73,9 |
| Chromium | 13,45 |
| Iron | 4,75 |
| Silicon | 4,25 |
| Boron | 3,00 |
| Carbon | 0,65 |

We claim:

1. A method of producing an elongate, thin, coherent and self-supporting body comprising a mass of discrete abrasive particles uniformly dispersed and held in a support matrix, the abrasive particles being present in an amount not exceeding 50 percent by volume of the body, including the steps of providing a mixture of the abrasive particles and the support matrix in particulate form, causing a thin layer of this mixture to be deposited on to a support surface, compacting the layer and heat treating the compacted layer under conditions which will not lead to degradation of the abrasive particles to produce the body.

2. A method according to claim 1 wherein the body has the form of a strip, sheet or the like.

3. A method according to claim 1 wherein the thickness of the body does not exceed 1 mm.

4. A method of claim 1 wherein the thickness of the body is in the range 0.2 to 0.7 mm.

5. A method of claim 1 wherein the thickness of the body is in the range 0.2 to 0.5 mm.

6. A method according to claim 1 wherein the support matrix is metallic.

7. A method according to claim 6 wherein the support matrix is an iron-containing alloy.

8. A method according to claim 1 wherein the abrasive particles are diamond or cubic boron nitride.

9. A method according to claim 1 wherein the abrasive particles are present in an amount of 20 to 40 percent by volume of the body.

10. A method according to claim 1 wherein the compaction is achieved under a pressure of up to 60 tons.

11. A method according to claim 1 wherein the matrix is metallic and the heat treatment is carried out at a temperature below the melting point of the metal.

12. A method according to claim 11 wherein the metal has a melting point above 1500° C. and the heat treatment is carried out at a temperature in the range 600° C. to 1000° C. for a period of 1 to 20 minutes.

13. A method according to claim 1 wherein a slurry of the particulate mixture and a film-forming binder material in water is made and the slurry is deposited on the support surface and a major part of the water is removed from the slurry before the compaction step.

14. A method according to claim 13 wherein the film-forming binder is a cellulose binder.

15. A method according to claim 1 wherein the body, after heat treatment, is subjected to further compaction or heat treatment steps or a combination of these steps.

16. A method of producing an elongate, thin, coherent and self-supporting strip having a thickness of less than 1 mm and comprising a mass of discrete abrasive particles uniformly dispersed and held in a metallic support matrix, the abrasive particles being present in an amount not exceeding 50 percent by volume of the strip and the metal having a melting point above 1500° C., including the steps of making a slurry a mixture of the abrasive particles and the support matrix, in particulate form, and a film-forming binder material in water, depositing a thin layer of the slurry on a support surface, removing a major part of the water from the slurry, compacting the layer, and heat treating the compacted layer at a temperature in the range 600° C. to 1000° C. for a period of 1 to 20 minutes in an atmosphere selected from non-oxidising, reducing and inert atmospheres.

17. A method of claim 16 wherein the abrasive particles are diamond particles.

* * * * *